US007743459B2

(12) United States Patent
Coccapani et al.

(10) Patent No.: US 7,743,459 B2
(45) Date of Patent: Jun. 29, 2010

(54) FLOOR WASHING-DRYING MACHINE

(75) Inventors: Sergio Coccapani, Parma (IT); Andrea Chignoli, Lodi (IT)

(73) Assignee: Nilfisk-Advance SpA, Lodi (IT)

( * ) Notice: Subject to any disclaimer, the term of this patent is extended or adjusted under 35 U.S.C. 154(b) by 0 days.

(21) Appl. No.: 12/318,100

(22) Filed: Dec. 22, 2008

(65) Prior Publication Data

US 2009/0188071 A1 Jul. 30, 2009

(30) Foreign Application Priority Data

Jan. 30, 2008 (IT) ..... PN2008A0006

(51) Int. Cl.
*A47L 7/00* (2006.01)

(52) U.S. Cl. ..... 15/320; 15/322; 15/401; 15/402

(58) Field of Classification Search ..... 15/320–322, 15/401, 402; *A47L 7/00*
See application file for complete search history.

(56) References Cited

FOREIGN PATENT DOCUMENTS

| | | | |
|---|---|---|---|
| EP | 1 917 898 | | 5/2008 |
| JP | 409206261 A | * | 8/1997 |

* cited by examiner

*Primary Examiner*—David A Redding
(74) *Attorney, Agent, or Firm*—Wenderoth, Lind & Ponack, L.L.P.

(57) ABSTRACT

A floor washing-drying machine includes a brush (2) adapted to scrub a floor (4) with a cleaning liquid in view of removing soil and dirt therefrom, and a wiping device (3) adapted to scrape the floor (4) in order to remove the dirty cleaning liquid therefrom. The wiping device (3) includes a front flap (5) and a rear flap (6) adapted to elastically and slidably engage the floor (4) so as to define a suction chamber (7) therebetween, with the suction chamber being fluidly connected with a suction device (8). A further elastic flap (10) is mounted to the wiping device behind the rear flap, and the width of the further flap is smaller than the width of the front and rear flaps (5, 6).

4 Claims, 2 Drawing Sheets

FLOOR WASHING-DRYING MACHINE

The present invention refers to a floor washing and drying machine provided with an improved floor wiping device.

Floor cleaning, i.e. washing-drying machines usually comprise a brushing device with water and/or liquid detergent dispensing provision to wash the floor, as well as a wiping device to remove the dirty liquid from the floor and dry up the latter.

Such wiping device has the purpose of scraping and vacuuming the floor behind the brushing device, in order to remove the dirty liquid therefrom by taking it in through suction means, which the wiping device itself is appropriately connected with.

The wiping device is usually comprised of a support, to which there are mounted two flaps (or wiping blades, as they are generally referred to in the art) that are made of a rubber-based or rubber-like material to be able to elastically and slidably engage the floor to be cleaned. These flaps, i.e. a front one and a rear one—as viewed in the forward direction of movement of the machine—are biased, i.e. pressed against the floor so as to substantially act as sealing gaskets and delimitate a suction chamber therebetween, which is connected to the suction or vacuuming means via a conduit. The rear flap has usually a larger thickness and is made of a softer material featuring a greater resistance to water and detergent liquid, since it must perform so as to be able to retain the dirty washing liquid inside the chamber for it to be effectively removed by suction.

The front flap has the task of conveying the liquid into the suction chamber and, to this purpose, it is in fact provided with a plurality of indentations or cuts made along the floor scraping border, i.e. the border in contact with the floor, so as to allow the washing liquid to seep into and enter the suction chamber. The provision of such indentations or cuts has the effect of reducing the negative pressure being created by the suction means inside the chamber, while allowing the air-liquid mixture to be anyhow correctly removed by suction.

In general, the greater is the negative pressure that is created inside the suction chamber, the better is the ability of the liquid to be effectively removed from the floor by suction.

Many machines of the above-noted kind—either with on-board driver or walking driver—have a preferred working direction, typically a forward direction of movement of the machine relative to the driver. In these machines, the wiping device is only effective in drying up the floor if the machine moves exactly in its forward direction.

A floor washing-drying machine of this kind is described for instance in the European patent application no. 07117884.2 filed by this same Applicant.

The floor drying effect of prior-art systems is largely known to be mainly affected by such factors as the tightness of the suction-chamber, the adherence of the rear flap against the floor, and the kind of floor being treated.

In particular, floors paved with tiles featuring fissured seams therebetween are the most difficult to dry up, since such seams generally represent corresponding discontinuities in the surface to be cleaned and wiped, as well as in the volume of the suction chamber. This practically gives rise to localized losses of both negative pressure inside the suction chamber and wiping effect of the rear flap, under corresponding loss of water and detergent. Moreover, when the flap of elastomeric material comes across a seam as the machine moves forwards, the free lip thereof, which is usually pressed down onto the floor, may spring up due to elastic effect and bounce away from the tile above the surface thereof, thereby worsening both the efficiency of the machine and the level of the cleaning effect to a further extent.

The macroscopic effects of this occurrence are to be noticed in a floor that dries up in quite imperfect a manner, with residual water drops near the seams between contiguous tiles and liquid splashes behind the wiper that hit the driver following the machine. The negative effect is still more conspicuous when the drying direction, i.e. the forward moving direction of the machine is perpendicular to the seams (as this is the most usual case, actually) and the wiper has a rounded shape or a delta-like configuration (typical configurations used in view of assisting water collection). In this case, in fact, discontinuities occur just in the zones in which water is conveyed and removed by suction.

It is therefore a main object of the present invention to provide a floor washing-drying machine that is provided with an improved wiping device that does away with the afore-cited drawbacks of prior-art embodiments.

Within this general object, it is a purpose of the present invention to provide a wiping device that is simple in its construction and capable of being fitted also in existing machines.

According to the present invention, these aims, along with further ones that will become apparent from the following disclosure, are reached in a floor washing-drying machine that is provided with a wiping device incorporating the characteristics as defined and recited in the following claims 1 et seq.

BRIEF DESCRIPTION OF THE DRAWINGS

Advantages and features of the present invention will anyway be more readily understood from the description of a preferred, although not sole embodiment that is given below by way of non-limiting example with reference to the accompanying drawings, in which.

DETAILED DESCRIPTION OF THE INVENTION

Figure 1:
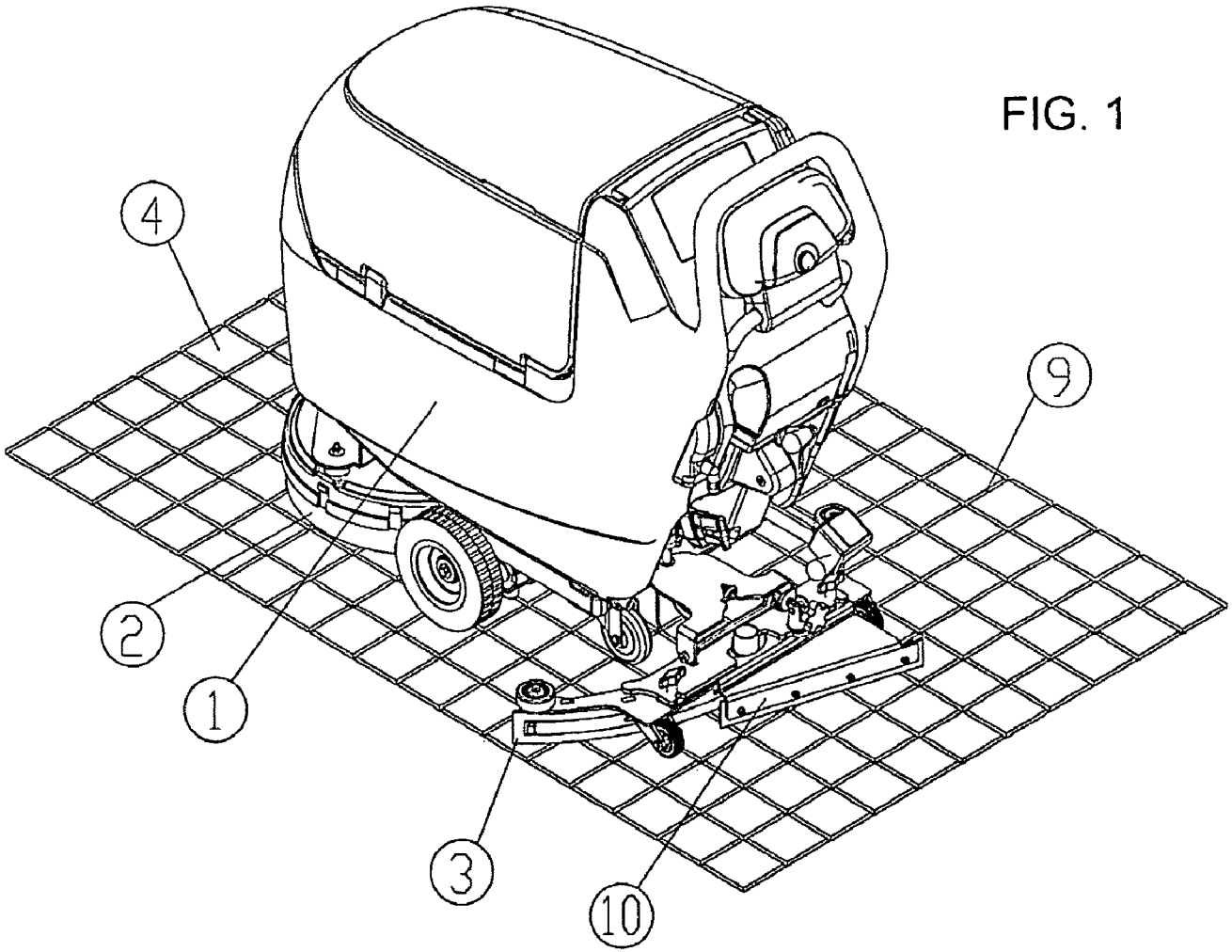
FIG. 1 is a rear perspective view of the floor-cleaning machine according to the present invention.

With reference to FIG. 1, the floor washing-drying machine according to the present invention, as generally indicated with the reference numeral 1 there, comprises brush means 2 adapted to scrub the floor 4 with a cleaning, i.e. detergent liquid in view of removing soil and dirt therefrom, and a wiping device 3 adapted to scrape the floor 4 in order to remove the dirty cleaning liquid therefrom. FIG. 1 shows a rear perspective view of the machine from the left side thereof, with the outer casing thereof partially removed for improved visibility of the wiping device.

The floor washing-drying machine shown in FIG. 1 comprises a chassis, on which there is mounted a housing body accommodating various component parts of the machine. Furthermore, the brush means 2 may comprise, for example, a pair of rotary brushes, which are arranged at a front end portion of the chassis of the machine, and are driven by suitable motor means. The machine further comprises a reservoir for storing a detergent liquid, which is due to be delivered by a pump to the brushes so that, when driven rotatably, these brushes are able to scrub the floor 4 with such detergent liquid to remove soil and dirt therefrom. For the dirty detergent liquid to be then collected for removal from the floor, the wiping device 3 is connected to suction means, such as a suction pump or compressor, which—via appropriate conduits—are connected to both the wiping device 3 and a collection container provided in the housing body. These component parts are fully traditional and any further description thereof is intentionally omitted herein, owing to them being already known as such from the disclosure in the afore-cited European patent application no. 07117884.2.

The wiping device 3 (FIGS. 1 and 2) comprises a front flap or elastic lip 5 and a rear flap or elastic lip 6 adapted to elastically and slidably engage the floor 4 to define a suction chamber 7 therebetween, wherein said suction chamber is fluidly connected to suction means (not shown) via a conduit 8.

Figure 2:
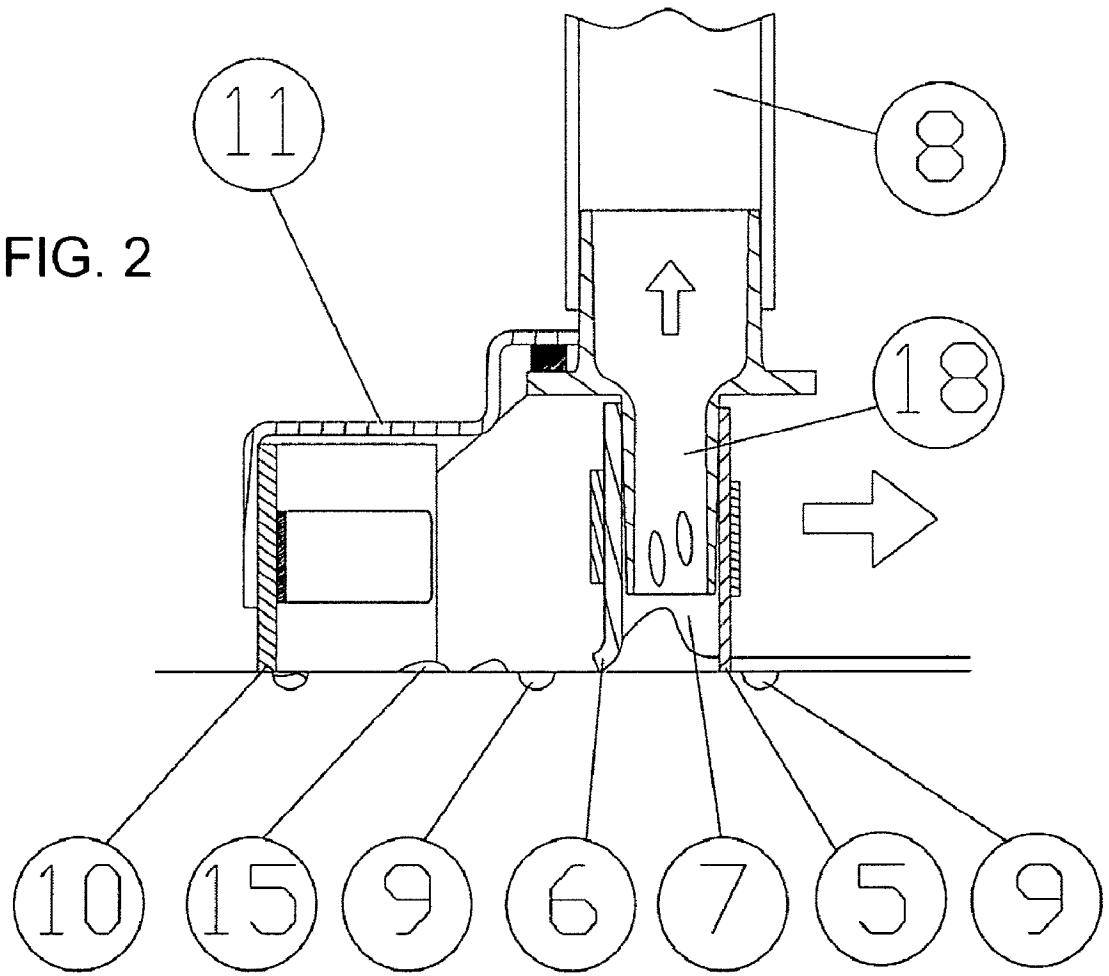
FIG. 2 is a basic schematical view of the wiping device of the floor-cleaning machine according to the present invention.

The conduit 8 is connected to the wiping device 3 through a suction conduit 18 that is fluidly connected with the suction chamber 7 (FIG. 2).

The front scraping flap 5 and the rear scraping flap 6 are typically different. In fact, the front scraping flap 5 is intended to convey the washing liquid so as to cause it to enter the suction chamber 7, whereas the rear scraping flap is intended to wipe the floor dry and retain the liquid inside the suction chamber 7.

To a large extent, the efficiency of the machine depends on the tightness of the suction chamber 7, in consideration of the various kinds of floors, on which the machine is used to washing and drying purposes.

In particular, floors paved with tiles featuring fissured seams 9 between contiguous tiles are the most difficult ones to dry up, since each such seam generally represents a discontinuity in the surface to be cleaned and wiped, and causes the volume of the suction chamber 7 to continuously vary. This practically gives rise to localized losses of both negative pressure inside the suction chamber and wiping effect of the rear flap 6, under corresponding leakage and loss of detergent liquid. Moreover, when the flap of elastomeric material comes across a seam 9 as the machine moves forwards, the free lip thereof, which is usually pressed down onto the floor, may spring up due to elastic effect and bounce away from the tile above the surface thereof, thereby worsening the effectiveness of the washing and drying process to a further extent.

The readily apparent effects of this occurrence are to be noticed in a floor that dries up in quite imperfect a manner under formation of residual water drops 15 or spots near the seams between contiguous tiles, and a generation of liquid splashes directed against the driver following the machine. The negative effect is still more conspicuous when the drying direction, i.e. the forward moving direction of the machine is perpendicular to the seams (as this is the most usual case, actually) and the wiper has a rounded shape or a delta-like configuration, as this is typically used in view of assisting liquid collection. In this case, in fact, discontinuities occur just in the zones in which liquid is conveyed and removed by suction.

According to the present invention (FIG. 2), the wiping device 3 is improved through the addition of a further elastic flap 10, as preferably made of a rubber-based or rubber-like material, which is mounted on a support 11 that is firmly joined to the wiping device 3. This further elastic flap 10 is provided behind the rear flap 6, at a short distance therefrom, and oriented obliquely relative to the forward moving direction of the machine (indicated by the arrow in FIG. 2). This feature has been devised in order to prevent such further flap 10 from being likely to come frontally across the seams 9 between contiguous tiles, since the same problem would in fact be incurred in this case as the one brought about by the rear flap bouncing up and down on the floor or, more exactly, on the discontinuities in the floor generated by the seams running between contiguous tiles. It will of course be appreciated that the inclination of the flap 10 relative to the forward moving direction of the machine shall not be excessive, in view of preventing the space taken longitudinally by the wiping unit from increasing to any unacceptable extent, which is an important feature especially in the case of machines operated by a driver walking behind them.

The above-mentioned further flap 10 is typically narrower in width than the other front and rear flaps 5 and 6. In addition, it forms a kind of screen guarding the machine driver against splashes of detergent liquid. In the case that a fissured seam between contiguous tiles fails to contain the whole amount of liquid remaining there after drying, such further flap 10 is effective in spreading such residual liquid over the next tile, thereby converting it into a thin film of liquid on the surface thereof. While the floor remains in this way wet, actually, it keeps being so for quite limited a period of time, since the thin liquid film is able to dry up by evaporation much more quickly than would large concentrated drops or spots of liquid 15, as this occurs in the operation of traditional machines.

Fully apparent from the above description is therefore the ability of the present invention to effectively reach the aforecited aims and advantages by providing a wiping device for a floor washing-drying machine that is more efficient and reliable than prior-art devices generally used in machines of the above-noted kind. Moreover, it can be readily appreciated that the novel solution can be easily and readily implemented also in existing floor washing-drying machines.

The invention claimed is:

1. A floor washing-drying machine, comprising:

a brush adapted to scrub a floor with a cleaning liquid so as to remove soil and dirt therefrom; and a wiping device adapted to scrape the floor in order to remove dirty cleaning liquid therefrom, said wiping device comprising a front flap and a rear flap adapted to elastically and slidably engage the floor so as to define a suction chamber therebetween, said suction chamber being fluidly connected with a suction device, said wiping device also comprising a further elastic flap arranged behind said rear flap and mounted on a support that is firmly joined to said wiping device, wherein a width of said further elastic flap is smaller than a width of said front and rear flaps, and wherein said further elastic flap is oriented obliquely relative to a forward moving direction of the machine.

2. A floor washing-drying machine according to claim 1, wherein said further elastic flap forms a screen guarding a machine driver against splashes of detergent liquid.

3. A floor washing-drying machine, comprising:

a brush adapted to scrub a floor with a cleaning liquid so as to remove soil and dirt therefrom; and a wiping device adapted to scrape the floor in order to remove dirty cleaning liquid therefrom, said wiping device comprising a front flap and a rear flap adapted to elastically and slidably engage the floor so as to define a suction chamber therebetween, said suction chamber being fluidly connected with a suction device, said wiping device also comprising a further elastic flap mounted to said wiping device and arranged behind said rear flap at a distance from said rear flap so as to spread a residual liquid into a film behind the machine, wherein a width of said further elastic flap is smaller than a width of said front and rear flaps, wherein said further elastic flap is mounted on a support that is firmly joined to said wiping device, and said further elastic flap is oriented obliquely relative to a forward moving direction of the machine.

4. A floor washing-drying machine according to claim 3, wherein said further elastic flap forms a screen guarding a machine driver against splashes of detergent liquid.

* * * * *